US006041968A

United States Patent [19]

Weiteder

[11] Patent Number: 6,041,968

[45] Date of Patent: Mar. 28, 2000

[54] DEVICE FOR OPENING AND RE-CLOSING CONTAINERS

[75] Inventor: Hans Weiteder, Herzogenrath, Germany

[73] Assignee: SIG Combibloc GmbH, Linnich, Germany

[21] Appl. No.: 09/117,148

[22] PCT Filed: Feb. 18, 1997

[86] PCT No.: PCT/EP97/00764

§ 371 Date: Jul. 23, 1998

§ 102(e) Date: Jul. 23, 1998

[87] PCT Pub. No.: WO97/31829

PCT Pub. Date: Sep. 4, 1997

[30] Foreign Application Priority Data

Feb. 28, 1996 [DE] Germany ..... 196 07 571
Mar. 20, 1996 [DE] Germany ..... 196 10 879

[51] Int. Cl.[7] ..... B67D 5/00

[52] U.S. Cl. ..... 222/83; 222/545; 229/125.15

[58] Field of Search ..... 222/83, 543, 545, 222/566; 229/125.14, 125.15; 220/277

[56] References Cited

U.S. PATENT DOCUMENTS

D. 331,877 12/1992 Robichaud et al. ..... D9/449
4,915,290 4/1990 Robichaud et al. ..... 229/125.08
4,925,034 5/1990 Robichaud et al. ..... 206/603
4,934,590 6/1990 Robichaud et al. ..... 229/125.09
5,101,999 4/1992 Robichaud et al. ..... 220/258
5,297,696 3/1994 Bernstein et al. ..... 222/83
5,325,983 7/1994 Imai et al. ..... 222/83 X
5,482,176 1/1996 Maietta et al. ..... 229/129.15 X

FOREIGN PATENT DOCUMENTS 0 332 800 9/1989 European Pat. Off. .
0 577 865 1/1994 European Pat. Off. .

*Primary Examiner*—Gregory L. Huson
*Attorney, Agent, or Firm*—Standley & Gilcrest LLP

[57] ABSTRACT

A device for the opening and re-closing of packages, more particularly flat, gabled, composite packages. The device consists generally of: a pouring aperture with a pouring nozzle formed thereon; a base having a flange enclosing the pouring aperture, for the attachment of the device to the surface of the container; a cover hinged to the base; and an opening element connected to the cover, the opening element disposed to move in a guide in the cover so that during the opening operation, the opening element pierces the subjacent container material through the pouring aperture in the base. The design is such that the clean opening and re-closing of the device is ensured and the package is tightly sealed. Opening of the package is accomplished by pressing an opening element consisting of a pressure plate and a piercing ring. After opening, the pressure plate remains with the cover, while the piercing ring remains in the base.

14 Claims, 3 Drawing Sheets

DEVICE FOR OPENING AND RE-CLOSING CONTAINERS

BACKGROUND AND SUMMARY OF THE INVENTION

The invention relates generally to a device for the opening and re-closing of containers, and more particularly, to flat, gabled, composite containers. The device of the present invention has a pouring aperture with a pouring nozzle formed thereon. There is a base having a flange enclosing the pouring aperture, for the attachment of the device to the surface of the container. A cover is hinged to the base, and an opening element is connected to the cover. The opening element is disposed to move in a guide in the cover, and is adapted to pierce the subjacent container material underlying the base during the opening operation. The invention also relates to the use of such a device with a flat, gabled, composite container and to flat, gabled, composite containers prepared for the application of said device.

Many constructions of parallelipipedic flat, gabled, composite containers are known. They are mainly used in the field of liquid packaging in connection with cold, cold-sterile, hot, and aseptic fillings. As a general rule, the packages cannot be re-closed once opened. In the case of flat, gabled, composite containers of the kind specified, it has already been suggested to place on the container gable, a pouring element which is provided with a corresponding cover (EP 0 577 865 A1). In order to weaken the gable material, a peripherally extending parting line is provided in the zone of the cardboard layer and the outer PE layer of the composite material. An opening element, connected to the cover and corresponding to the shape of the peripherally extending parting line, is forced through this weakened area of the container. After the container has been pierced, the pouring opening is accessed by hinging the cover open. The opening element and the piece of container composite disposed thereon will remain jointly hinged open, allowing the contents of the container to pass through the pouring opening. This prior art device is disadvantageous, as droplets of the contents of the container may remain on the piece of container composite hinged open together with the cover and then drip down onto the table or floor during the pouring operation, thereby reducing the efficient operation of the known device. This is particularly problematic in the case of fruit juices containing sugar, as the PE foil utilized in such packages tends to tear irregularly at the edges. Moreover, the re-closing of the device may lead to leakage, since the irregular tearing edge of the PE foil may result in jamming in the pouring aperture when the cover is closed. In addition to functional problems, the piece of container composite removed with the open cover makes for an unattractive appearance.

Therefore, one aspect of the present invention is to provide an improved device for the opening and re-closing of containers of the type described above, wherein the clean opening and re-closing of the device is ensured and high sealing tightness is achieved in the container. In addition, consumers require a device that is simple to operate, fully functional during the opening operation and attractive in appearance. This problem is solved by the device of the present invention, wherein the opening is constructed in two parts; mainly a pressure plate and a piercing ring, and wherein after opening the container, the piercing ring remains in the base.

The device according to the present invention can be put into effect with any kind of flat, gabled, composite container.

However, it is particularly convenient if the flat, gabled, composite container to which the device is applied, has a peripherally extending weakening line, corresponding to the contour of the desired pouring opening and disposed in the zone of the subsequent pouring aperture. A flat, gabled, composite container can also have a supporting layer formed with a recess, which is disposed in the zone of the subsequent pouring aperture, corresponds to the contour of the desired pouring opening, and is sealed over with at least one PE layer.

According to one embodiment of the present invention, the underside of the pressure plate may have at least one peripherally extending web for receiving the piercing ring. Such a web can be disposed both in the interior and also around the exterior of the piercing ring. In another embodiment, two concentrically disposed webs could be provided whose spacing corresponds precisely to the thickness of the piercing ring. Alternatively, the cover and/or the opening element may possess a peripherally extending groove for receiving the piercing ring.

Since the opening element is preferably disposed displaceably in the cover, the device may also include at least one stop to limit the movement of the opening element. During the opening operation, the stop can reliably prevent the opening element from breaking away from the cover and entering the inside of the container. Another stop may be employed to affix the opening element to the cover after the container has been opened.

In another embodiment of the present invention, the piercing ring may have teeth to aid in piercing the container. The teeth may be arranged to produce a puncture of specific shape. Alternatively, a cutting edge may be substituted for the teeth. The user handles these alternative constructions of the opening element in an identical manner as the embodiments previously described. The pressing of the opening element into the closure member separates the section of composite material surrounding the weakening line and the section of PE foil sealed over the recess from the remainder of the container composite. The sections of composite and PE foil are then forced into the interior of the container. The teeth disposed on the piercing ring preferably do not extend completely around its periphery. This allows a section of both the composite material and the PE foil to remain attached, thus preventing the sections from entering the contents of the container. Allowing the sections to completely disengage from the container and enter its contents should be avoided, as problems may be caused during pouring if the freely floating sections completely or partially block the pouring aperture, or pass through the pouring aperture to a receptacle.

In a preferred construction of the device of the present invention, the piercing ring remains in the base after the opening operation. When the cover is hinged open the pressure plate is separated from the piercing ring, so that the pressure plate remains in the cover. To ensure the reliable separation and final location of these components, the outer surface of the piercing ring may also contain retaining elements. These retaining elements may take the form of projections and/or beads, for example, and assist in retaining the piercing ring in the base.

As is known from the earlier described prior art, in a preferred embodiment of the present invention, the cover is pivotally connected to the base. Preferably, the pivotal connection also has means for securing the cover in its opened position. This is particularly convenient, since it precludes the cover from inadvertently pivoting toward its closed position and inhibiting the flow of the contents from the package during the pouring operation.

In a preferred embodiment of the present invention, the cover and the opening element inserted therein, may form a flush surface when in the transport (closed) position. A flush surface provides for an attractive appearance and prevents the collection of dust or dirt above the opening element.

Although various shapes are possible, for ease of manufacture the pouring aperture and the piercing ring preferably have a round cross-section. A round cross-section also ensures that the force exerted on the opening element during the opening operation is evenly distributed around its periphery.

Preferably, the base, the cover, and the opening element are made of a plastic material. The base and the cover may be produced in one piece by injection molding. The opening element can be produced separately, in two parts, and inserted in the cover prior to application to the container.

In addition to the novel features and advantages mentioned above, other objects and advantages of the present invention will be readily apparent from the following descriptions of the drawings and preferred embodiments, wherein.

DETAILED DESCRIPTION OF THE PREFERRED EMBODIMENT(S)

Figure 1:
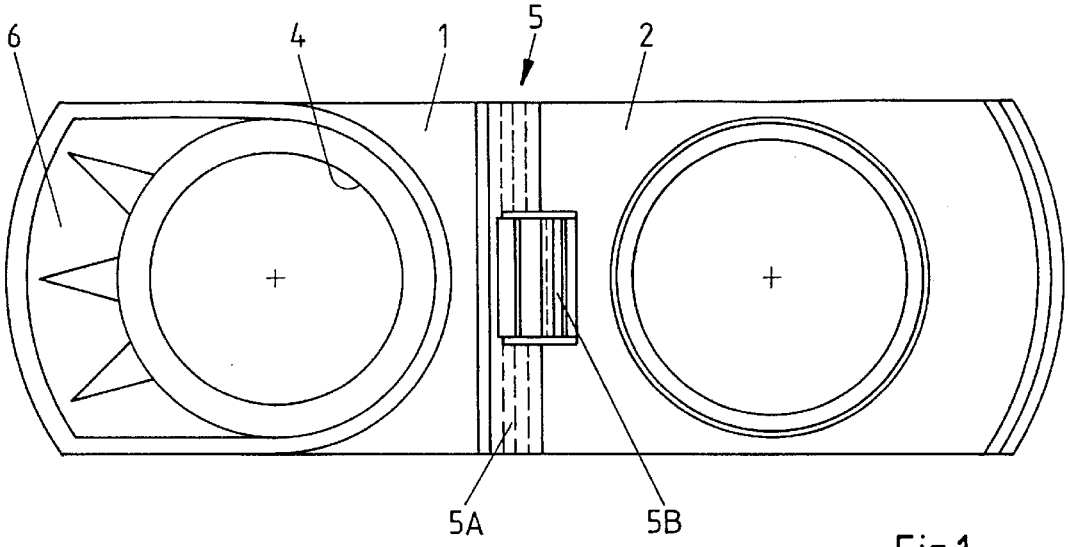
FIG. 1 is a plan view showing a preferred embodiment of the device of the present invention in the open position and without an opening element.
Figure 2:
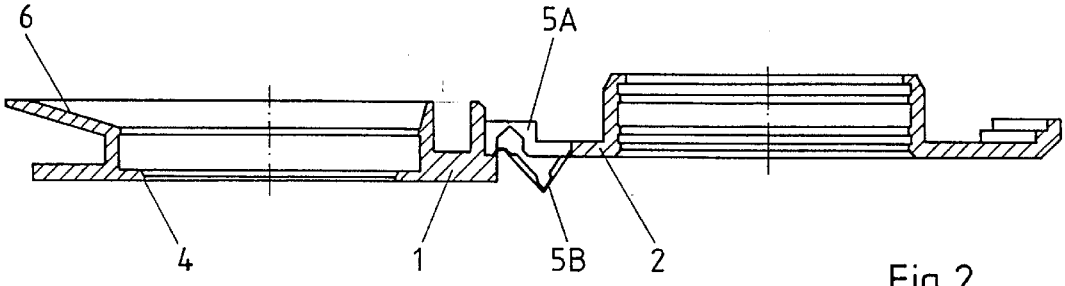
FIG. 2 is a cross-sectional view illustrating the preferred embodiment of the device of the present invention as shown in FIG. 1.
Figure 3:
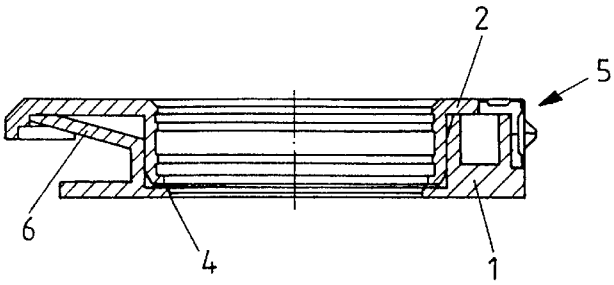
FIG. 3 is a cross-sectional view of the preferred embodiment of the device of the present invention as depicted in FIGS. 1 and 2, but shown in the closed position.

FIGS. 1–3 illustrate the basic construction of the device of the present invention. The device has a base 1 and a cover 2. Although it would normally reside in the cover 2, for purposes of clarity, an opening element (3 in FIG. 4) is not shown in FIGS. 1–3.

Referring to FIGS. 1 and 2, it can be observed that the base 1 has a pouring aperture 4 and is pivotally connected to the cover 2 via a unitary, injection molded strap hinge 5A. In the preferred embodiment shown, the pivotal connection is effected via both the actual strap hinge 5A and a latching element 5B, which is disposed in the central zone of the strap hinge and is provided to latch the cover 2 in its opened position.

Referring to FIG. 2, a pouring nozzle 6 extending from the pouring aperture 4 acts as a pouring aid to carry the contents of the container beyond the container edge (not shown). It can be seen with reference to FIG. 3, that with the cover 2 closed, the opening of pouring nozzle 6 is completely enclosed. Thus, in addition to sealing the pouring aperture 4, the cover 2 also prevents dust or dirt from impinging on the pouring nozzle 6.

Figure 4:
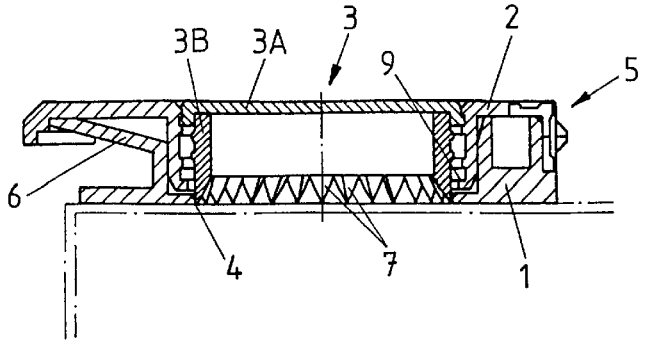
FIG. 4 is a cross-sectional view of the preferred embodiment of the device of the present invention as shown in FIGS. 1–3, further disclosing an opening element inserted in the transport position.
Figure 7:
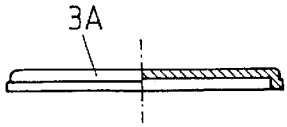
FIG. 7 is a half cross-sectional view of a pressure plate, utilized in the opening element of the preferred embodiment of the present invention as shown in FIGS. 4–6.
Figure 8:
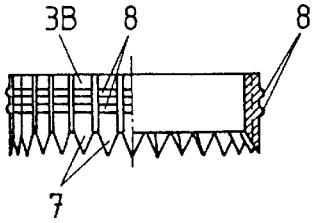
FIG. 8 is a half cross-sectional view of a piercing ring, utilized in the opening element of the preferred embodiment of the present invention as shown in FIGS. 4–6.
Figure 9:
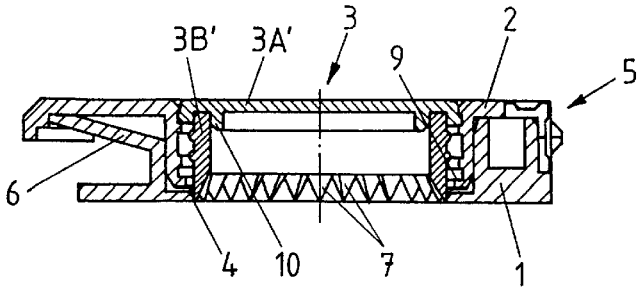
FIG. 9 is a cross-sectional view showing an alternate embodiment of the device of the present invention, with an opening element in the transport position.
Figure 10:
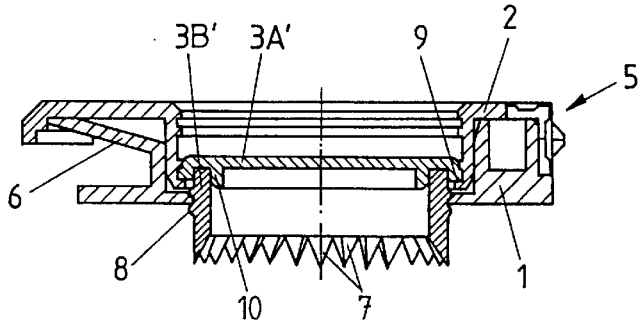
FIG. 10 is a cross-sectional view of the device of the present invention as illustrated in FIG. 9, wherein the opening element is shown in the forced-in position.
Figure 11:
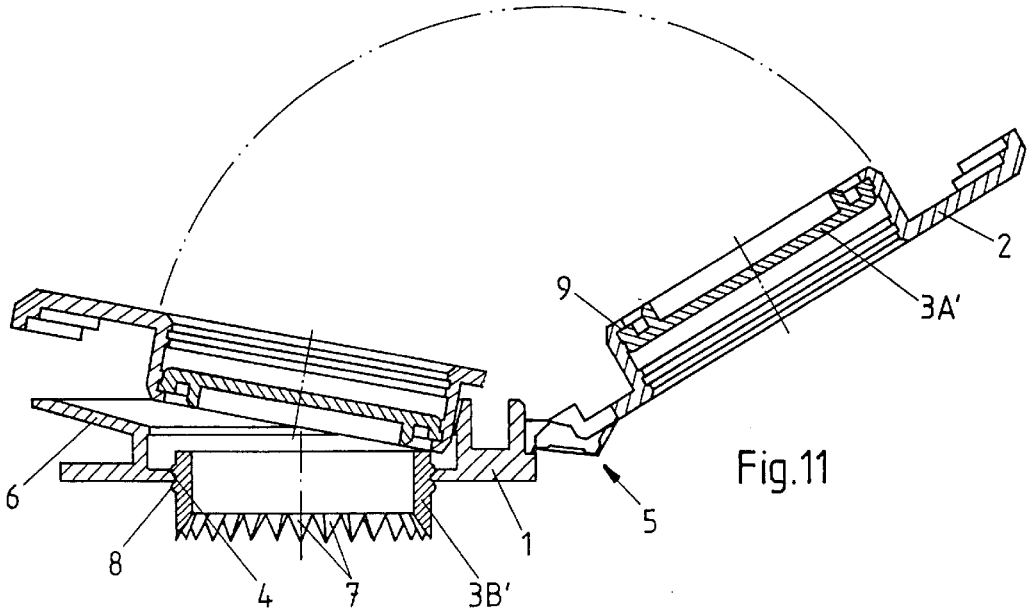
FIG. 11 is a cross-sectional view illustrating the device of the present invention as shown in FIG. 10, with the opening element in two different opening positions.
Figure 12:
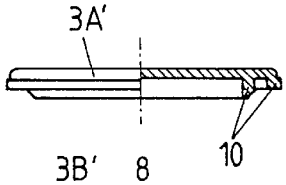
FIG. 12 is a half cross-sectional view of a pressure plate, utilized in the opening element of the preferred embodiment of the present invention as shown in FIGS. 9–12.
Figure 13:
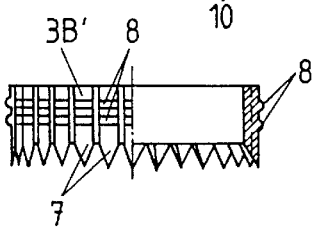
FIG. 13 is a half cross-sectional view of a piercing ring, utilized in the opening element of the preferred embodiment of the present invention as shown in FIGS. 9–12.

FIG. 4 is a cross-sectional view showing a preferred embodiment of a complete device as contemplated by the present invention. The device is shown in FIG. 4 applied to the container surface, which is indicated by phantom lines. As can be seen, the opening element 3 residing in the cover 2 is comprised of a pressure plate 3A and a piercing ring 3B, the surface of the pressure plate being flush with the surface of the cover after assembly. The pressure plate 3A and piercing ring 3B can be respectively seen in the detail views of FIGS. 7 and 8.

To open a container, force is exerted on the pressure plate 3A, such as by a finger, which drives the pressure plate into the cover 2. The force exerted on the pressure plate is transferred to the piercing ring 3B, causing the piercing ring to protrude through the pouring aperture 4 in the base 1 and penetrate the composite material and the PE foil of the package. The device is generally positioned over an area of the container containing weakening lines (not shown), which allows the shape of the punch-out to be more readily dictated. It is particularly helpful if the piercing ring possesses an opening aid. As can be seen by reference to FIG. 8, and also in FIGS. 4–6, the opening aid may take the form of teeth 7 around at least a portion of the periphery of the piercing ring 3B. Preferably, the teeth 7 (or other opening aid) attached to the piercing ring 3B do not extend completely around its periphery, thereby allowing a portion of the punch-out to remain attached to the container. This prevents the punch-out from falling into the contents of the container. The cover 2 also preferably has one or more stops 9 to limit the inward travel of the opening element 3 during the opening operation.

Figure 5:
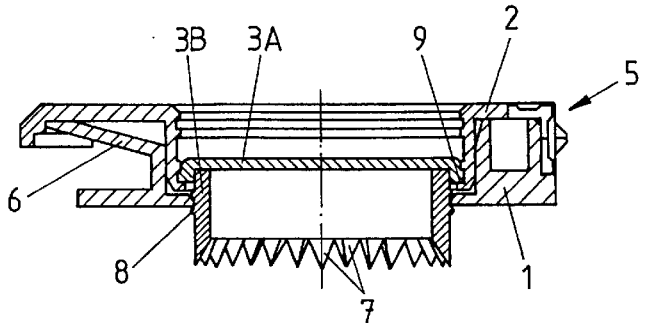
FIG. 5 shows a cross-sectional view of the preferred embodiment of the device of the present invention as shown in FIG. 4, with the opening element in the forced-in position.
Figure 6:
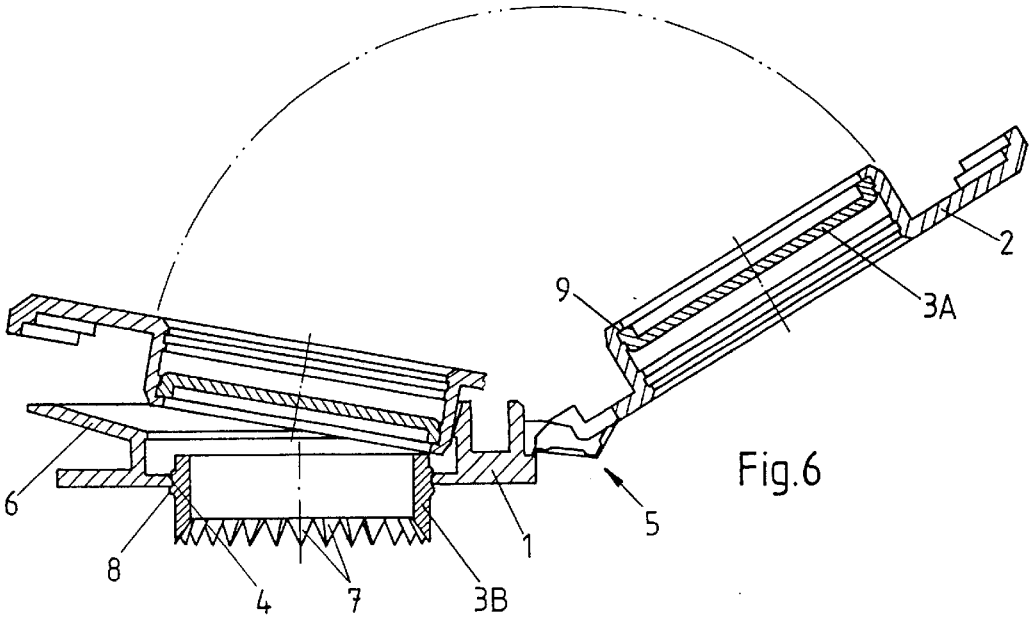
FIG. 6 is a cross-sectional view illustrating the preferred embodiment of the device of the present invention as shown in FIG. 5, with the opening element in two different opening positions.

FIGS. 4 and 5 also reveal retaining elements 8 that may protrude from the outer surface of the piercing ring 3B. Once the piercing ring 3B has been forced into the container material, the retaining elements 8 help to retain the piercing ring in that position. As can be observed in FIG. 6, when the cover 2 is subsequently raised, the pressure plate 3A will be removed from the pouring aperture 4 and continue to reside in the cover, but the piercing ring 3B will remain in the pouring aperture 4 of the base 1.

FIGS. 9–13 show an alternate embodiment of the device according to the present invention, wherein the opening element 3 comprises a slightly varied pressure plate 3A' and a corresponding piercing ring 3B'. This embodiment is differentiated from the embodiment previously disclosed by a peripherally extending web 10 on the bottom surface of the pressure plate 3A'. The peripherally extending web 10 is designed to extend into the interior of the piercing ring 3B'. Therefore, in this preferred embodiment, the piercing ring 3B' is reliably guided and prevented from deviating from the weakening line and the recess in the composite container, since the piercing ring 3B' is trapped in the groove formed by the peripherally extending web 10 and the outside wall of the pressure plate 3A'. A detailed view of the pressure plate 3A' and the piercing ring 3B' can be seen in FIGS. 12 and 13.

I claim:

1. A device for the opening and re-closing of containers, more particularly flat, gabled, composite containers, said device comprising:

a pouring aperture;

a pouring nozzle formed thereon;

a base having a flange enclosing said pouring aperture, said base for the attachment of said device to a surface of said container;

a cover connected to said base;

an opening element displaceably connected to said cover, said opening element adapted so that during opening of said container, a portion of said opening element extends through said pouring aperture in said base and penetrates the subjacent container material;

wherein said opening element consists of two parts, mainly a pressure plate and a piercing ring; and wherein after opening of said container said piercing ring remains in said base.

2. The device of claim 1, wherein the underside of said pressure plate has at least one peripherally extending web for receiving said piercing ring.

3. The device of claim 1, wherein the underside of said pressure plate has a peripherally extending groove for receiving said piercing ring.

4. The device of claim 1, wherein said cover and/or said opening element has at least one stop for limiting the movement of said opening element.

5. The device of claim 1, wherein said piercing ring has apertures distributed over its periphery.

6. The device of claim 1, wherein said piercing ring has as an opening aid extending from at least a portion of its bottom edge.

7. The device of claim 1, wherein the outer surface of said piercing ring has at least one retaining element for assisting in the retention of said piercing ring in said base after opening of said container.

8. The device of claim 1, wherein said cover is hingedly connected to said base and the hinged connection has a retaining element for releasably securing the cover in its opened position.

9. The device of claim 1, wherein said cover and said opening element inserted therein, form a flush surface when in a closed or transport position.

10. The device of claim 1, wherein said pouring aperture and said piercing ring have a round cross-section.

11. The device of claim 1, wherein said base, said cover, and said opening element are made from a plastic material.

12. The device of claim 1, further comprising a flat, gabled, composite container, and more particularly a beverage container.

13. The device of claim 12, further comprising a weakening line in said composite container, said weakening line extending peripherally in the area of said pouring aperture and substantially corresponding to the contour of said pouring aperture.

14. The device of claim 1, further comprising a flat, gabled, composite container, more particularly a beverage container, having in a supporting layer a recess disposed in the area of said pouring aperture, said recess substantially corresponding to the contour of said pouring aperture and sealed over with at least one PE layer.

* * * * *